US006597124B2

(12) United States Patent
Park et al.

(10) Patent No.: US 6,597,124 B2
(45) Date of Patent: Jul. 22, 2003

(54) PLASMA DISPLAY PANEL

(75) Inventors: Young Chan Park, Kyongsangbuk-do (KR); Won Tae Kim, Kyongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/851,144

(22) Filed: May 9, 2001

(65) Prior Publication Data

US 2001/0040435 A1 Nov. 15, 2001

(30) Foreign Application Priority Data

May 9, 2000 (KR) ..... 2000-24720
May 9, 2000 (KR) ..... 2000-24721

(51) Int. Cl.[7] ..... G09G 3/10
(52) U.S. Cl. ..... 315/169.4; 313/509
(58) Field of Search ..... 315/169.3, 169.4, 315/169.1; 313/506, 509, 581, 586, 587, 582

(56) References Cited

U.S. PATENT DOCUMENTS 4,996,460 A * 2/1991 Kim et al. ..... 313/586
5,541,479 A * 7/1996 Nagakubo ..... 313/586
5,627,347 A * 5/1997 Kwon ..... 178/18.05
5,793,158 A * 8/1998 Wedding, Sr. ..... 313/493
2002/0008472 A1 * 1/2002 Ha ..... 313/582

FOREIGN PATENT DOCUMENTS

JP 04-095331 3/1992

* cited by examiner

*Primary Examiner*—Don Wong
*Assistant Examiner*—Thuy Vinh Tran
(74) *Attorney, Agent, or Firm*—Fleshner & Kim, LLP

(57) ABSTRACT

A plasma display panel prevents electrostatic force between upper and lower substrates and noise and error discharge due to non-uniformity. The plasma display panel includes a lower substrate, a plurality of barriers formed on the lower substrate, an upper substrate, a dielectric layer formed on the upper substrate to have grooves of a predetermined depth along regions adjoining the barriers, and a plurality of ground electrodes formed between the barriers and the grooves of the dielectric layer, having both ends commonly connected to one another. Thus, it is possible to prevent noise of the product resulting from vibration of the upper and lower substrates from occurring and optimize the operation conditions, thereby improving quality of the product.

46 Claims, 4 Drawing Sheets

PLASMA DISPLAY PANEL

BACKGROUND OF THE INVENTION

1. Field of the Invention

The present invention relates to a flat panel display device, and more particularly, to a plasma display panel.

2. Discussion of the Related Art

Generally, a plasma display panel and a liquid crystal display (LCD) have lately attracted considerable attention as the most practical next generation display of flat panel displays. In particular, the plasma display panel has higher luminance and a wider viewing angle than the LCD. For this reason, the plasma display panel is widely used as a thin type large-sized display such as an outdoor advertising tower, a wall TV and a theater display.

A related art plasma display panel of three-electrode area discharge type will be described with reference to the accompanying drawings.

As shown in FIG. 1*a*, the related art plasma display panel of three-electrode area discharge type includes an upper substrate 10 and a lower substrate 20 which face each other. In FIG. 1*b*, the lower substrate 20 is rotated by 90°.

The upper substrate 10 includes scan electrodes 16 and 16', sustain electrodes 17 and 17', a dielectric layer 11, and a passivation layer 12. The scan electrodes 16 and 16' are formed in parallel to the sustain electrodes 17 and 17'. The dielectric layer 11 is deposited on the scan electrodes 16 and 16' and the sustain electrodes 17 and 17'.

The lower substrate 20 includes address electrodes 22, a dielectric layer 21 formed on an entire surface of the substrate including the address electrodes 22, barriers 23 formed on the dielectric layer 21 between the respective address electrodes 22 to divide respective discharge cell regions, and a phosphor 24 formed on surfaces of the barriers 23 in each discharge cell and of the dielectric layer 21.

Inert gases such as He and Xe are mixed in a space between the upper substrate 10 and the lower substrate 20 at a pressure of 300 to 700 Torr. The space forms a discharge area.

The operation of the aforementioned AC type plasma display panel of three-electrode area discharge type will now be described.

If a driving voltage is applied between each address electrode and each scan electrode, opposite discharge occurs between the address electrode and the scan electrode. Some electrons emitted from the inert gas within the discharge cell come into collision with a surface of the dielectric layer due to the opposite discharge. The collision of the electrons secondarily emits electrons from the surface of the dielectric layer. The secondarily emitted electrons come into collision with a plasma gas to diffuse the discharge. If the opposite discharge between the address electrode and the scan electrode ends, wall charges having opposite polarities occur on the surface of the passivation layer on the respective address and scan electrodes.

If the discharge voltages having opposite polarities are continuously applied to the scan electrode and the sustain electrode and at the same time the driving voltage applied to the address electrode is cut off, area discharge occurs in a discharge area on the surfaces of the dielectric layer and the dielectric layer due to potential difference between the scan electrode and the sustain electrode. The electrons in the discharge cell come into collision with the inert gas in the discharge cell due to the opposite discharge and the area discharge. As a result, the inert gas in the discharge cell is excited and ultraviolet rays having a wavelength of 147 nm occur in the discharge cell. The ultraviolet rays come into collision with the phosphors surrounding the address electrode and the barriers, so that the ultraviolet rays are emitted. Thus, the plasma display panel is operated.

The plasma display panel has several problems.

Electrostatic force occurs between the upper and lower substrates as the power source is applied to the plasma display panel to operate the plasma display panel. At this time, since the scan electrode and the sustain electrode are alternately formed inside the panel, the electrostatic force may be removed. However, since either the scan electrode or the sustain electrode exists outside the panel, charges are accumulated. If the accumulated charges become great, the upper and lower substrates vibrate when the plasma display panel is operated by the electrostatic force. For example, Just like a Speaker vibration. For this reason, noise occurs. The noise mainly occurs outside the panel, but the noise may occur inside the panel due to the electrostatic force that partially remains without being removed.

When an adhesive material is deposited on the upper and lower substrates to attach them to each other, the adhesive material is not uniformly deposited on the upper and lower substrates. Also, pressures between respective directions of a holder that fixes the upper and lower substrates to each other are not uniform. As a result, noise may occur or error discharge may be caused.

SUMMARY OF THE INVENTION

Accordingly, the present invention is directed to a plasma display panel that substantially obviates one or more of the problems due to limitations and disadvantages of the related art.

An object of the present invention is to provide a plasma display panel that prevents electrostatic force of upper and lower substrates and noise and error discharge due to non-uniformity.

Additional features and advantages of the invention will be set forth in the description which follows, and in part will be apparent from the description, or may be learned by practice of the invention. The objectives and other advantages of the invention will be realized and attained by the scheme particularly pointed out in the written description and claims hereof as well as the appended drawings.

To achieve these and other advantages and in accordance with the purpose of the present invention, as embodied and broadly described, a plasma display panel according to the present invention includes a lower substrate, a plurality of barriers formed on the lower substrate, an upper substrate, a dielectric layer formed on the upper substrate to have grooves of a predetermined depth along regions adjoining the barriers, and a plurality of ground electrodes formed between the barriers and the grooves of the dielectric layer, having both ends commonly connected to one another.

In another aspect, a plasma display panel according to the present invention includes an upper substrate, a lower substrate, a plurality of barriers formed between the upper substrate and the lower substrate to divide respective discharge cells, an adhesive material deposited on a predetermined region of the upper substrate or the lower substrate to attach the upper substrate to the lower substrate, and a plurality of support members having a predetermined length and a width, formed at constant intervals along a region where the adhesive material is deposited, so that the support members in pairs oppose each other based on the region deposited with the adhesive material.

It is to be understood that both the foregoing general description and the following detailed description are exemplary and explanatory and are intended to provide further explanation of the invention as claimed.

BRIEF DESCRIPTION OF THE DRAWINGS

The invention will be described in detail with reference to the following drawings in which like reference numerals refer to like elements wherein.

DETAILED DESCRIPTION OF THE PREFERRED EMBODIMENTS

Reference will now be made in detail to the preferred embodiments of the present invention, examples of which are illustrated in the accompanying drawings.

First Embodiment

A plasma display panel according to the first embodiment of the present invention will be described with reference to FIG. 2.

Figure 2:
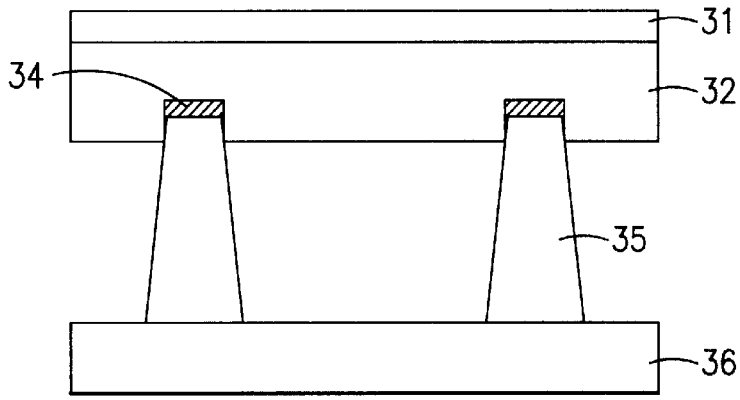
FIG. 2 is a sectional view illustrating a plasma display panel according to the first embodiment of the present invention.

As shown in FIG. 2, the plasma display panel according to the first embodiment of the present invention includes a lower substrate 36, a plurality of barriers 35 formed on the lower substrate 36, an upper substrate 31, a dielectric layer 32 formed on the upper substrate 31 to have grooves of a predetermined depth along regions adjoining the barriers 35, a plurality of first ground electrodes 34 formed along the grooves of the dielectric layer 32, and a plurality of second ground electrodes (shown in FIG. 3) formed on the upper substrate 31 to respectively connect with both ends of the first ground electrodes 34.

A structure of the upper substrate 31 will be described in more detail with reference to FIG. 3.

Figure 3:
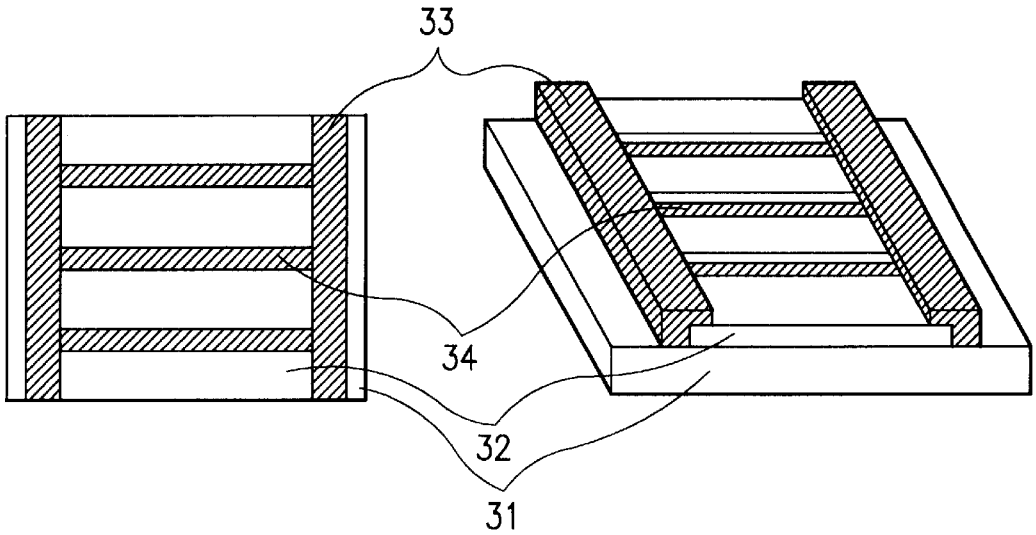
FIG. 3 shows a plane view and a perspective view illustrating a structure of an upper substrate of FIG. 2.

As shown in FIG. 3, some of the barriers 35 are fitted into regions of the dielectric layer 32, where will adjoin the barriers 35, so that fixing and coupling characteristics can be improved, there by forming the grooves that prevent noise generated by vibration of the panel when the panel is operated.

The first ground electrodes 34 are formed in the grooves at a thickness smaller than the depth of the grooves. The first ground electrodes 34 are formed at a thickness smaller than the depth of the grooves and serve to earth current components that are induced in the barriers 35 when the panel is normally operated to generate electrostatic force and generate noise by vibration of the panel due to the electrostatic force.

Subsequently, the second ground electrodes 33 are formed at both ends of each groove of the dielectric layer 32 by commonly connecting both ends of the first ground electrodes 34, so that the second ground electrodes 33 earth the current components through the first ground electrodes 34 and also earth the current components remaining in the outer portion of the panel. The second ground electrodes 33 are symmetrically formed in a "¬" shape to surround a part of the dielectric layer 32.

The process for manufacturing the aforementioned plasma display panel according to the present invention will be described below.

A sustain electrode (not shown) is formed in a predetermined region of the upper substrate 31. A dielectric layer 32 is formed in a predetermined region of the upper substrate 31 including the sustain electrode.

A region of the dielectric layer 32, where adjoins the barriers 35, is etched to form the grooves of a predetermined depth so that some of the barriers 35 are fitted into the grooves.

The first ground electrodes 34 are formed in the grooves at a predetermined thickness smaller than the depth of the grooves. At this time, since the first ground electrodes 34 serves to earth storage charges of the dielectric layer 32, the first ground electrodes 34 may be formed on the barriers 35 to be in contact with the dielectric layer 32.

Subsequently, the second ground electrodes 33 are formed at both ends of each groove of the dielectric layer 32 by commonly connecting both ends of the first ground electrodes 34 with one another. The second ground electrodes 33 are symmetrically formed in a "¬" shape to surround a part of the dielectric layer 32.

At this time, in the plasma display panel, a region where noise most frequently occurs is an outer portion of the panel. Since either the scan electrode or the sustain electrode is formed in the outer portion of the panel, charges are accumulated, thereby generating the electrostatic force. In this case, the panel vibrates due to the electrostatic force, thereby generating noise. Accordingly, the second ground electrodes 33 removes the electrostatic force of the outer portion of the panel and at the same time removes the electrostatic force through the first ground electrodes 34. As a result, noise can be prevented from occurring by forming the second ground electrodes 33 only without forming the first ground electrodes 34.

In the same manner as the related art, the lower substrate 36, the address electrode (not shown), the barriers 35 for dividing the respective discharge cell, and the fluorescent layer (not shown) are formed. After the upper and lower substrates are attached to each other, a discharge gas is injected into them through an exhaust hole so that the exhaust gas is tipped off. Thus, the process for manufacturing the plasma display panel is completed.

In the plasma display panel according to the present invention, the grooves are formed in the dielectric layer 32 and both ends of the dielectric layer 32 are surrounded by the second ground electrodes 33 so that coupling and fixing characteristics between the barrier 35 and the upper substrate 31 can be improved. When a voltage is applied, the current components induced through the barriers 35 are earthed through the first and second ground electrodes 34 and 33.

Accordingly, in the plasma display panel according to the present invention, coupling and fixing characteristics of the barriers can be improved by improving a structure of the upper substrate and unnecessary current components which are induced through the barriers and cause electrostatic force between the upper and lower substrates are earthed using the ground electrode. Thus, it is possible to prevent noise of the product resulting from vibration of the upper and lower substrates from occurring and optimize the operation conditions, thereby improving quality of the product.

In the plasma display panel according to the first embodiment of the present invention, both the grooves and the ground electrode are formed in the dielectric layer, so that electrostatic force between the upper and lower substrates can be prevented from occurring and noise and error discharge due to non-uniformity can be avoided. However, even if the grooves are only formed in the dielectric layer, it is possible to improve coupling and fixing characteristics of the barriers, thereby preventing noise from occurring when the panel is operated. Also, even if the ground electrode is only formed in the dielectric layer, it is possible to remove the electrostatic force that causes vibration of the upper and lower substrates, thereby preventing noise from occurring when the panel is operated.

Second Embodiment

A plasma display panel according to the second embodiment of the present invention will be described with reference to FIG. 4.

Figure 4:
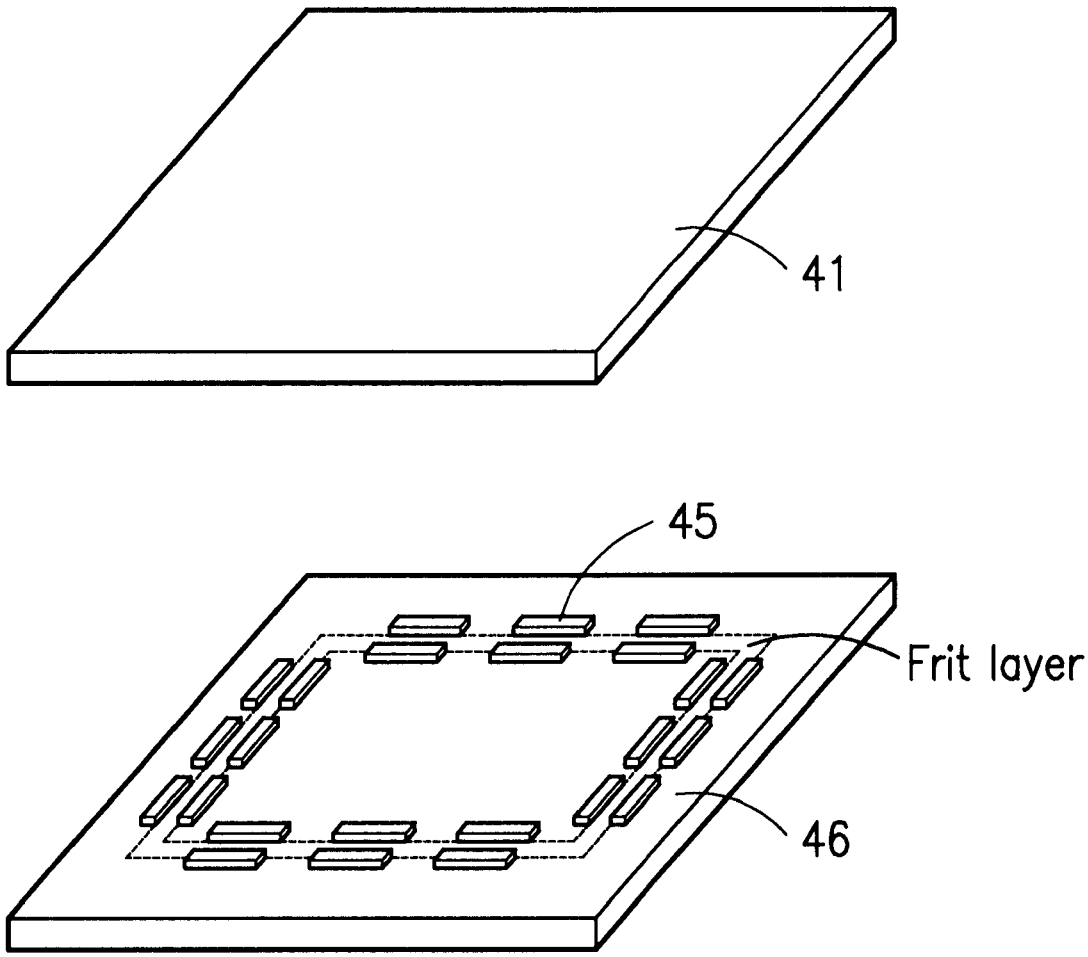
FIG. 4 is a perspective view illustrating a plasma display panel according to the second embodiment of the present invention.

As shown in FIG. 4, a structure of the plasma display panel according to the second embodiment of the present invention is similar to that of the plasma display panel according to the third embodiment of the present invention. Unlike the first embodiment of the present invention, in the second embodiment of the present invention, a plurality of support members 45 are formed at constant intervals along a region of a lower substrate 46 on which a frit is deposited, so that the support members in pairs oppose each other based on the region deposited with the frit. The support members 45 serve to maintain a uniform distance between an upper substrate 41 and the lower substrate 46 by uniformly maintaining a thickness of the frit when the upper substrate 41 is attached to the lower substrate 46.

Figure 1A:
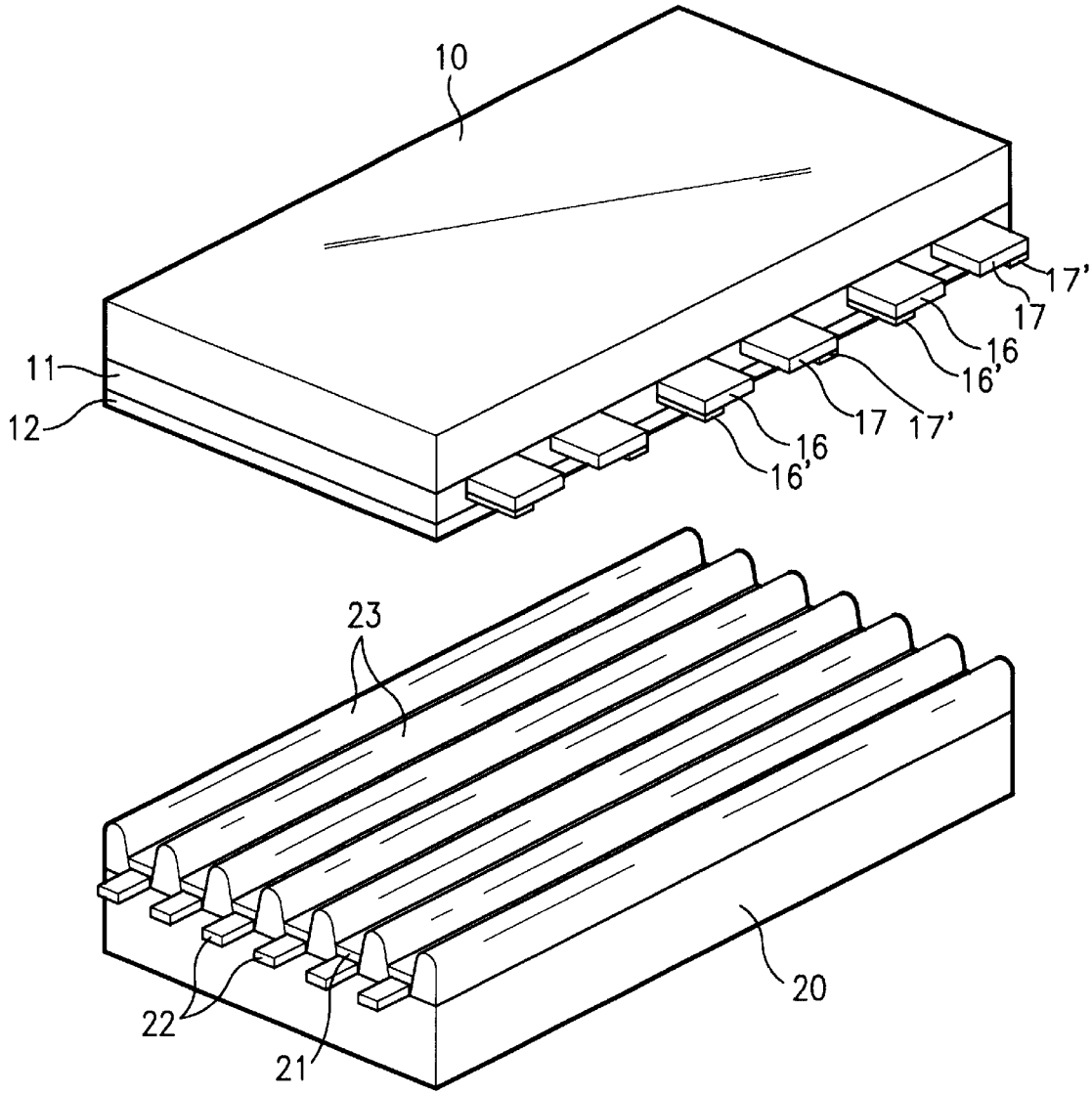
FIG.1A Related Art
FIGS. 1*a* and 1*b* are a perspective view and a sectional view illustrating a general plasma display panel.
Figure 1B:
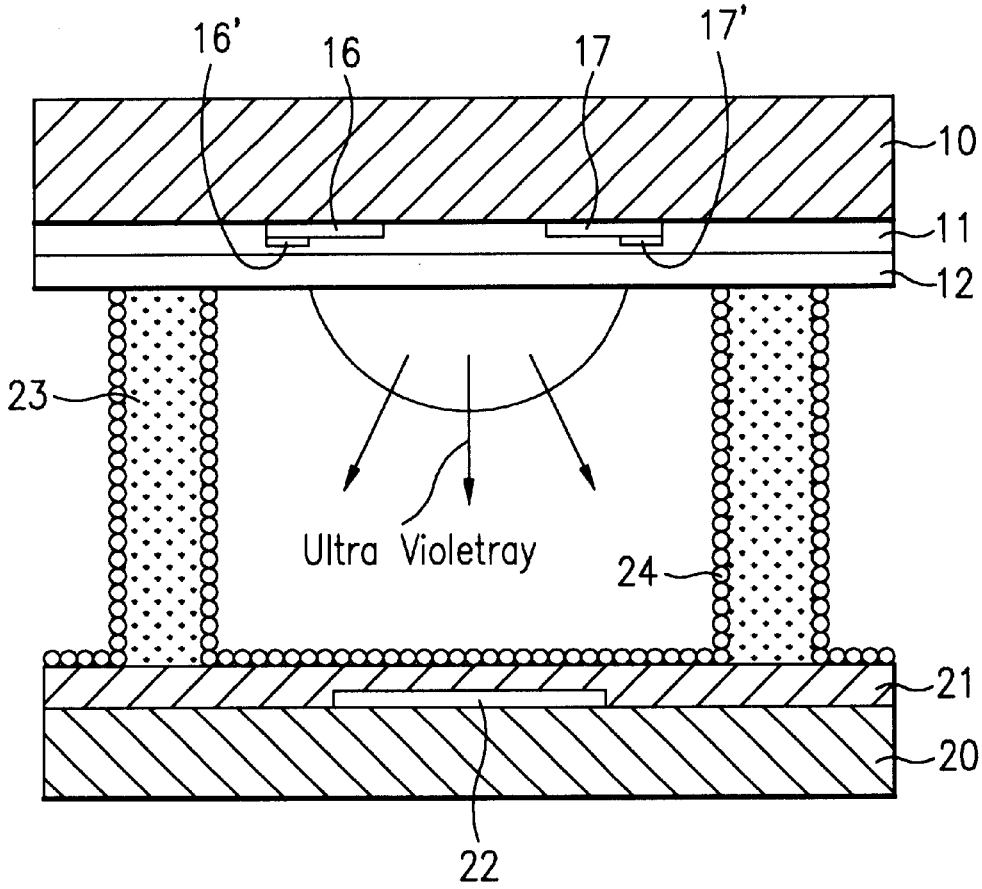
FIG.1B Related Art

The support members 45 can be formed of the same material as that of the existing barriers 23 shown in FIGS. 1*a* and 1*b* or a material that is not deformed by a pressure of an adhesive holder. The support members 45 are formed by a printing method.

Furthermore, since the support members 45 should uniformly maintain the thickness of the frit deposited between the support members in pairs, they have the same thickness as one another. The support members 45 are spaced apart from one another at a predetermined distance in a longitudinal direction so that the frit deposited at a thickness thicker than other portions is uniformly distributed and the extra frit is exhausted out. At this time, since the support members are spaced apart from one another in a longitudinal direction to exhaust out the frit, the spaced distance of the support members 45 does not necessarily require the same distance.

As described above, if the structure of the upper substrate 41 and the lower substrate 46 is completed, the upper substrate 41 is attached to the lower substrate 46.

To attach the upper substrate 41 to the lower substrate 46, the frit is deposited on a space surrounded by the support members 45. The upper substrate 41 and the lower substrate 46 are fixed to each other using a plurality of tongs shaped holders and then fired.

At this time, the support members 45 of the same thickness surround the frit and are spaced apart from one another at a predetermined distance. Accordingly, even if the frit is deposited on a predetermined portion of the frit deposited region at a greater amount than other portions, the frit is pushed to a portion where the frit is deposited at a small amount or exhausted out through the spaced portion, thereby uniformly maintaining the whole thickness of the frit.

After the upper substrate 41 and the lower substrate 46 are attached to each other, they are maintained at the uniform distance on the whole region.

In the second embodiment of the present invention, a number of the spaced portions are formed so that the frit is uniformly deposited or quickly exhausted out. Also, the support members 45 are formed in all positions of the lower substrate 46 that can form the support members 45.

However, if the support members 45 have the same thickness and the spaced portions are formed so that the frit of a greater amount is exhausted out, the number of the support members 45 may be changed and their shape may be varied. In other words, the support members 45 may be formed in an appropriate position (for example, four corners) so that they are maintained at the same distance to correspond to the pressure applied by the holders regardless of the upper substrate 41 and the lower substrate 46.

Furthermore, since the support members 45 are formed in the frit deposited region, i.e., outside an actual screen display region, the support members 45 may be formed on either any one of the upper and lower substrates 41 and 46 or both the upper and lower substrates 41 and 46.

As described above, the plasma display panel according to the present invention has the following advantages.

Since the thickness of the frit is uniformly maintained using the support members after the upper substrate is attached to the lower substrate, the uniform distance between the upper and lower substrates is maintained so that noise and error discharge can be prevented from occurring, thereby improving reliability of the product.

The foregoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A plasma display panel comprising:

a lower substrate;

a plurality of barriers formed on the lower substrate;

an upper substrate;

a dielectric layer formed on the upper substrate to have grooves of a predetermined depth along regions adjoining the barriers; and a plurality of ground electrodes formed between the barriers and the grooves of the dielectric layer, having both ends commonly connected to one another.

2. The plasma display panel of claim 1, wherein the ground electrodes include a plurality of first ground electrodes formed between the barriers and the grooves of the dielectric layer, and a plurality of second ground electrodes formed on the upper substrate to respectively connect with both ends of the first ground electrodes.

3. The plasma display panel of claim 2, wherein the first ground electrodes are formed in the grooves of the dielectric layer.

4. The plasma display panel of claim 2, wherein the first ground electrodes are formed on the barriers.

5. The plasma display panel of claim 2, wherein the first ground electrodes have a thickness smaller than a depth of the grooves.

6. The plasma display panel of claim 2, wherein the second ground electrodes have a thickness greater than a thickness of the dielectric layer.

7. A plasma display panel comprising:

a lower substrate;

a plurality of barriers formed on the lower substrate;

an upper substrate;

scan electrodes and sustain electrodes alternately formed on the upper substrate;

a dielectric layer formed on the upper substrate including the scan electrodes and the sustain electrodes, having grooves of a predetermined depth along regions adjoining the barriers; and a plurality of ground electrodes formed outside the dielectric layer in a vertical direction against the scan electrodes or the sustain electrodes.

8. The plasma display panel of claim 7, wherein the ground electrodes have a thickness greater than a thickness of the dielectric layer.

9. The plasma display panel of claim 7, wherein some of the ground electrodes are formed to surround the dielectric layer.

10. A plasma display panel comprising:

a lower substrate;

a plurality of barriers formed on the lower substrate;

an upper substrate; and a dielectric layer, formed along regions of the upper substrate, adjoining the barriers, and having grooves of a predetermined depth, wherein the barrier adjoins the dielectric layer in the grooves.

11. A plasma display panel comprising:

a lower substrate;

a plurality of barriers formed on the lower substrate;

an upper substrate;

scan electrodes and sustain electrodes alternately formed on the upper substrate;

a dielectric layer formed on the upper substrate including the scan electrodes and the sustain electrodes; and a plurality of ground electrodes formed outside the dielectric layer in a vertical direction against the scan electrodes or the sustain electrodes.

12. The plasma display panel of claim 11, wherein the ground electrodes have a thickness greater than a thickness of the dielectric layer.

13. The plasma display panel of claim 11, wherein some of the ground electrodes are formed to surround the dielectric layer.

14. A plasma display panel comprising:

a lower substrate;

a plurality of barriers formed on the lower substrate;

an upper substrate;

scan electrodes and sustain electrodes alternately formed on the upper substrate;

a dielectric layer formed on the upper substrate including the scan electrodes and the sustain electrodes; and a plurality of ground electrodes formed between the barriers and regions of the dielectric layer adjoining the barriers, having both ends commonly connected to one another.

15. The plasma display panel of claim 14, wherein the ground electrodes include a plurality of first ground electrodes formed between the barriers and the regions of the dielectric layer adjoining the barriers, and a plurality of second ground electrodes formed on the upper substrate to respectively connect with both ends of the first ground electrodes.

16. The plasma display panel of claim 15, wherein the first ground electrodes are formed on the barriers.

17. The plasma display panel of claim 15, wherein the first ground electrodes are formed on the regions of the dielectric layer adjoining the barriers.

18. The plasma display panel of claim 15, wherein the second ground electrodes have a thickness greater than a thickness of the dielectric layer.

19. The plasma display panel of claim 15, wherein some of the second ground electrodes are formed to surround the dielectric layer.

20. A plasma display panel comprising:

an upper substrate;

a lower substrate;

a plurality of barriers formed between the upper substrate and the lower substrate to divide respective discharge cells;

an adhesive material deposited on a predetermined region of the upper substrate or the lower substrate to attach the upper substrate to the lower substrate; and a plurality of support members having a predetermined length and a width, formed at constant intervals along a region where the adhesive material is deposited, so that the support members in pairs oppose each other based on the region deposited with the adhesive material.

21. The plasma display panel of claim 20, wherein the support members are formed of the same material as that of the barriers.

22. The plasma display panel of claim 20, wherein the support members in pairs have the same length and width as each other.

23. The plasma display panel of claim 20, wherein the constant intervals are equal to one another.

24. The plasma display panel of claim 20, wherein some of the constant intervals are not equal to one another.

25. An apparatus comprising:

a first substrate;

a second substrate;

a dielectric layer between the first substrate and the second substrate, wherein the dielectric layer includes at least one groove; and at least one barrier between the first substrate and the second substrate, wherein the at least one barrier contacts the dielectric layer in the at least one groove.

26. The apparatus of claim 25, wherein the dielectric layer is on the second substrate.

27. The apparatus of claim 25, wherein the at least one barrier is on the first substrate.

28. The apparatus of claim 25, wherein the apparatus is a plasma display panel.

29. The apparatus of claim 25, comprising at least one ground electrode.

30. The apparatus of claim 25, wherein the at least one ground electrode is in the at least one groove.

31. The apparatus of claim 25, wherein the at least one ground electrode is on the at least one barrier.

32. The apparatus of claim 25, wherein the at least one ground electrode has a thickness less than the depth of the at least one groove.

33. The apparatus of claim 25, wherein the at least one ground electrode has a thickness greater than the thickness of the dielectric layer.

34. An apparatus comprising:

a first substrate;

a second substrate;

a dielectric layer between the first substrate and the second substrate;

at least one barrier between the first substrate and the second substrate; and at least one ground electrode between the first substrate and the second substrate.

35. The apparatus of claim 34, wherein the dielectric layer is on the second substrate.

36. The apparatus of claim 34, wherein the at least one barrier is on the first substrate.

37. The apparatus of claim 34, wherein the apparatus is a plasma display panel.

38. The apparatus of claim 34, wherein the dielectric layer comprises at least one groove.

39. The apparatus of claim 38, wherein the at least one barrier contacts the dielectric layer in the at least one groove.

40. The apparatus of claim 38, wherein the at least one ground electrode is in the at least one groove.

41. The apparatus of claim 38, wherein the at least one ground electrode has a thickness less than the depth of the at least one groove.

42. The apparatus of claim 34, wherein the at least one ground electrode is on the at least one barrier.

43. The apparatus of claim 34, wherein the at least one ground electrode has a thickness greater than the thickness of the dielectric layer.

44. An apparatus comprising:

a first substrate;

a second substrate;

at least one barrier between the first substrate and the second substrate;

an adhesive between the first substrate and the second substrate; and at least one support member between the first substrate and the second substrate, wherein the at least one support member surrounds the adhesive.

45. The apparatus of claim 44, wherein the apparatus is a component of a plasma display panel.

46. The apparatus of claim 44, wherein each of the at least one support member has the same thickness.

* * * * *